United States Patent [19]

Hodges et al.

[11] Patent Number: 4,517,058

[45] Date of Patent: May 14, 1985

[54] METHOD FOR ELECTROFORMING METAL SLUGS AND REUSABLE INTEGRATED CATHODE UNIT

[75] Inventors: Donald R. Hodges, Denver; William G. Sherwood, Golden, both of Colo.

[73] Assignee: AMAX Inc., Greenwich, Conn..

[21] Appl. No.: 548,125

[22] Filed: Nov. 2, 1983

[51] Int. Cl.[3] ..... C25D 1/00; C25D 17/12

[52] U.S. Cl. ..... 204/4; 204/8; 204/281

[58] Field of Search ..... 204/4, 8, 12, 281

[56] References Cited

U.S. PATENT DOCUMENTS 3,577,330 4/1971 Knapp et al. ..... 204/10

4,040,915 8/1977 Fisher ..... 204/12

4,082,641 4/1978 Parkinson et al. ..... 204/281

*Primary Examiner*—Howard S. Williams

*Attorney, Agent, or Firm*—Michael A. Ciomek; Eugene J. Kalil

[57] ABSTRACT

A cathode matrix is provided for producing dislodgeable metal slugs of electrolytically deposited metal comprising a laminar metal substrate having an array of raised bosses with exposed flat faces distributed over the substrate and integral therewith. The total surface of the cathode is covered by an adherent layer of an electrolyte resistant, substantially impermeable, low electrical conductivity material, such as fluorinated hydrocarbon, except for the exposed faces of the bosses, the exposed faces being adapted to receive electrodeposited metal thereon.

9 Claims, 4 Drawing Figures

METHOD FOR ELECTROFORMING METAL SLUGS AND REUSABLE INTEGRATED CATHODE UNIT

This invention relates to the production of electrolytically deposited subdivided nickel of controlled size, such as a slug, e.g. piece, button, crown, etc., and to a reusable integrated cathode for use in producing dislodgeable electrolytically deposited subdivided nickel of controlled size.

STATE OF THE ART

It is known to produce electrorefined subdivided nickel of controlled size by depositing nickel on a cathode in the form of a matrix having conductive islands of controlled size defined on the surface thereof, the conductive islands being insulated from each other on the surface by a non-conductive resist, such that each island is separated from an adjacent island.

In U.S. Pat. No. 3,668,081, a process is disclosed for electroforming metals, including nickel, cobalt and iron, upon a sheet mandrel made either of stainless steel, titanium or aluminum. The mandrel is prepared by chromium plating faces thereon, applying to the chromium plated faces a thermosetting epoxy ink or paint containing dicyandiamide as a hardener in the desired pattern as by, for example, silk screen printing, curing the ink or paint film by heating, and thereafter electrodepositing metal thereon. The ink or paint film may be applied to a desired pattern and may form a continuous pattern of interconnecting lines or areas on the face of the sheet so as to define conductive areas having the desired shape and size for the plated shapes to be produced.

In U.S. Pat. No. 3,577,330, a process is disclosed for producing electrolytic nickel in subdivided form using a reusable sheet cathode having conductive islands defined on the surface thereof. The metal, e.g. nickel, is deposited under conditions of low stress to provide electrolytic nickel deposits having substantial thickness upon the islands, the deposited nickel being thereafter removed and sheet cathode reused.

The disclosures of the aforementioned patents are incorporated herein by reference and form part of the disclosure thereof.

It would be desirable to provide a reusable cathode matrix capable of producing metal deposits of controlled size and shape and which can be easily removed from the deposited portions of the cathode by prying or other simple mechanical means.

We have now found that we can produce dislodgeable electrolytically deposited subdivided nickel of controlled size, such as a slug, button, etc., by using a novel cathode matrix.

OBJECTS OF THE INVENTION

It is an object of the invention to provide a method for producing dislodgeable electrolytically deposited nickel slugs.

Another object is to provide a reusable integrated cathode matrix for producing by electrolytic deposition dislodgeable nickel slugs, such as in the shape of crowns. These and other objects will more clearly appear from the following disclosure, claims and accompanying drawing, wherein:

SUMMARY OF THE INVENTION

Stating it broadly, the invention is directed to a cathode matrix for producing dislodgeable slugs, pieces, etc., of electrolytically deposited metal. The cathode matrix is comprised of a laminar substrate having thereon an array of raised bosses with exposed flat faces distributed over said substrate and integral therewith.

The total surface of said cathode is covered with an adherent layer of an electrolyte-resistant, substantially impermeable, low electrical conductivity material, except for the exposed faces of said bosses, the exposed faces being adapted to receive electrodeposited metal thereon. Preferred materials are fluorinated hydrocarbons. The bosses are preferably cylindrical in shape. The metal particles deposited on the faces of the bosses have a crown configuration due to the high current density that prevails at the edges of the raised bosses, which configuration is desirable in that the crowns are mechanically dislodgeable.

The fluorinated hydrocarbons can be any of the following: to wit, polytetrafluoroethylene, otherwise known by the trademark Teflon, polyvinyl fluoride (PVF), polytrifluorochloroethylene, polyvinylidene fluoride, polytrifluoroethylene and copolymers thereof.

The invention is also directed to a method for producing electrolytically deposited metal slugs, the method comprising inserting into a metal-containing electrolyte an anode and a cathode, the cathode comprising a cathode matrix in the form of a laminar metal substrate having an array of raised bosses with exposed flat faces distributed over the substrate and integral therewith. The total surface of the cathode is covered with an electrolyte resistant, substantially impermeable plastic material, such as a fluorinated hydrocarbon, except for the exposed faces of the bosses which are adapted to receive electrodeposited metal thereon. A current is passed from the anode to the cathode, whereby metal is electrodeposited on the exposed faces of said bosses, the deposition being continued until the desired size of the electrodeposited slug is obtained on the faces of the bosses.

By employing cylindrically shaped bosses, the deposited slug is in the shape of a crown which can be easily mechanically removed from the surface of the bosses by prying the crown from the cathode with a screwdriver or knife.

The cathode substrate may be an anodizable metal, such as stainless steel, titanium, aluminum, etc. Stainless steel is preferred, e.g., 18/8 stainless. A steel containing 8–30% Cr, 8–15% Ni and the balance iron can be used.

DETAILS OF THE INVENTION

Figure 2:
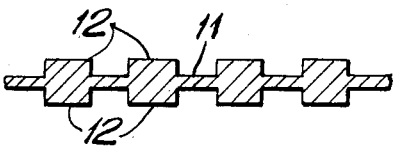
FIG. 2 is a cross section of the cathode matrix of FIG. 1 taken along line 2—2.
Figure 1:
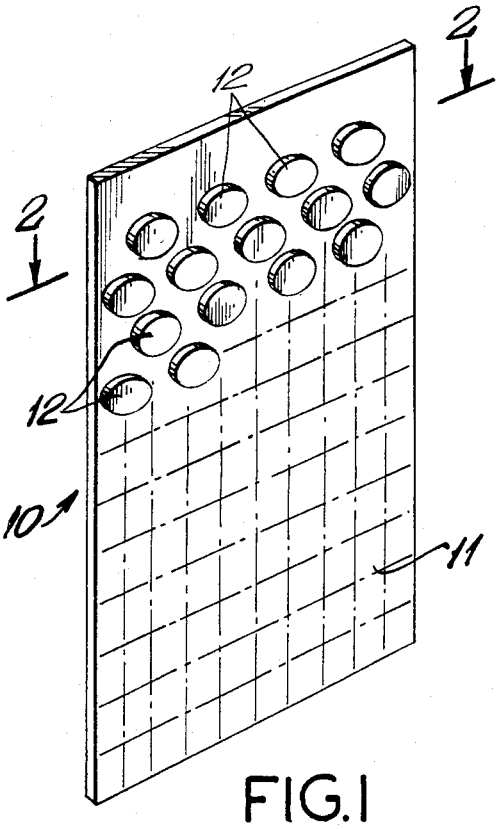
FIG. 1 is a three-dimensional view of a cathode matrix provided by the invention.

Referring to the drawing, FIG. 1 shows a cathode matrix designated by the numeral 10 comprising a stainless steel substrate 11 having an array of raised bosses 12 which in this case appear on both sides of the cathode as shown in FIG. 2. As stated herein, the cathode matrix is completely covered with a layer of a fluorinated hydrocarbon except for the exposed flat faces of bosses 12.

Figure 3:
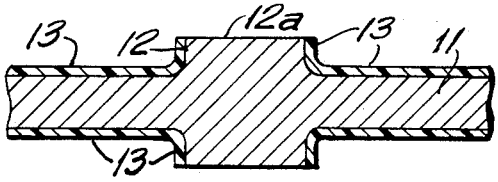
FIG. 3 is an enlarged cross section of a segment of the cathode matrix showing the resist coating of a plastic material, such as a fluorinated hydrocarbon.

Referring to the enlarged cross section of FIG. 3, a cathode segment is shown showing the substrate 11 and the sidewalls of the bosses 12 covered with a fluorinated hydrocarbon 13, e.g. Teflon, with the surface 12*a* of the bosses left exposed to receive electrodeposited metal.

Figure 4:
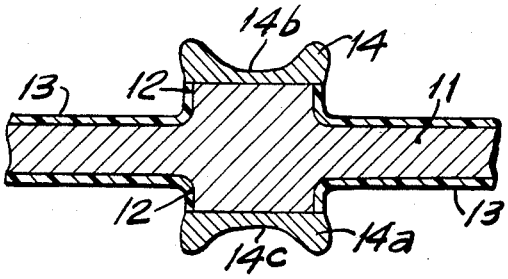
FIG. 4 is a similar cross section showing an electrodeposited slug of nickel of controlled size in the shape of a crown.

Referring to FIG. 4, a cathode segment is shown depicting the formation of electrolytically deposited nickel 14, 14*a* in the shape of crowns on bosses 12. These crowns are easily dislodged. The crowns typically have smooth interior faces 14*b*, 14*c* surrounded by an annular ring approximately three times thicker than the central part of the crown or button which gives the slug the crown configuration.

The reusable cathode is preferably produced from a solid sheet of 316 stainless steel by (1) machining a pattern of ½ inch diameter bosses ⅛ inch high, (2) coating the entire sheet with fluoronated hydrocarbon material at elevated temperature, and (3) by removing the coating material from the upper surface of the upstanding boss to expose only the ½ inch diameter face. The applied coating is strongly bonded to the steel substrate.

The one-piece integrated cathode precludes the necessity for welding electrical leads to each active plating surface. The use of the fluorocarbon coating, which is very inert, protects the base material in any plating solution. Plating tests have confirmed substantial adherence of the plated buttons or crowns to the cathode, but not so much adherance as to prevent easy disengagement when desired.

The crowns produced in the tests ranged in weight from 3 to 10 grams. In the absence of agitation, or at high pH, or at low current density, the central region 14*b*, 14*c* (FIG. 4) developed dendritic growths. In all cases, the crowns or buttons were easily removed from the cathode, requiring only a slight prying action with a screwdriver or knife. During tests performed in a large cell, no more than 1 or 2 crowns (< 0.4%) detached from the cathodes during the plating operation.

The complete analyses of crown produced in a 1-liter cell and a 20-liter cell are given in the table below:

ANALYSES OF NICKEL CROWNS

| Impurity | Concentration, ppm 1-Liter Cell | 20-Liter Cell |
|---|---|---|
| Cu | 220 | 110 |
| Co | 12,600 | 7,900 |
| Fe | 187 | 900 |
| Zn | 2,600 | 1,400 |
| Pb | 437 | <10 |
| Bi | 30 | <200 |
| Mn | <5 | <10 |
| $SiO_2$ | — | 270 |
| Sn | — | 60 |
| S | 15 | 9 |
| P | 220 | <10 |
| As | — | <10 |
| Sb | — | <10 |
| Se | — | 400 |
| Te | — | <10 |
| Ag | — | 0.33 |

In general, crowns produced in the 20-liter cell were of greater purity than those produced in the 1-liter cell. This discrepancy is probably attributable to the smaller nickel cut taken from the larger cell (3 gpl vs 5 gpl).

The nickel solutions employed in forming the nickel slugs were leach solutions obtained in the acid leaching of nickel-containing material. Typically, the solutions may contain 80 gpl Ni, 2 gpl Co and sufficient sulfuric acid to provide a pH of about 2.5 to 5. The solutions employed in U.S. Pat. No. 3,577,330 may also be employed.

The electrolyte temperature was maintained at 50° C., pH at 2.8 and current density at 920 A/m$^2$. Test cells of 1-liter and 20-liter volumes were used. The smaller cell contained a single cathode of geometric dimensions 12×14 cm with 9 blanks (bosses) per face (11 cm$^2$/face). Electrolyte was recirculated through the cell at 1 liter/minute. The larger cell contained a single cathode of dimensions 30×90 cm with 283 blanks (bosses) per face (358 cm$^2$/face). Electrolyte was passed through this cell at 20 l/minute. In the small cell, a 5 gpl $Ni^{2+}$ "cut" was taken during electrolysis; a 3 gpl $Ni^{2+}$ "cut" was taken during operation of the large cell.

The cathodes were fabricated from a solid sheet of 316 S.S., rather than by using "inserts" pressed into appropriately sized holes. This method of fabrication allows for simple insulation of those portions of the cathode on which plating is not desired and ensures good contact between the cathode bus bar and active cathode plating areas.

The term "electrodeposited slug" is meant to cover all shapes of metal deposits, such as pieces, buttons, crowns, discs, etc.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A cathode matrix for producing dislodgeable metal slugs of electrolytically deposited metal comprising a laminar metal substrate having an array of raised cylindrical bosses with sidewalls and having exposed flat faces distributed over said substrate and integral therewith, the total surface of said cathode including the sidewalls of said bosses being covered by a coating comprising an adherent layer of an electrolyte resistant, substantially impermeable, low conductivity material, except for the exposed faces of said bosses, the coated sidewalls of said raised bosses extending upwardly from the surface of the coated laminar metal substrate, said exposed faces of said coated raised bosses being adapted to receive electrodeposited metal thereon.

2. The cathode matrix of claim 1, wherein the adherent layer of electrolyte resistant material is a fluorinated hydrocarbon.

3. The cathode matrix of claim 2, wherein the fluorinated hydrocarbon is polytetrafluoroethylene.

4. The cathode matrix of claim 2, wherein the metal substrate is an anodizable metal selected from the group consisting of stainless steel, titanium and aluminum.

5. The cathode matrix of claim 4, wherein the metal substrate is stainless steel.

6. A method for producing electrolytically deposited metal slugs which comprises, inserting into a metal-containing electrolyte an anode and a cathode, said cathode comprising a cathode matrix in the form of a laminar metal substrate having an array of raised cylindrical bosses with sidewalls and having exposed flat faces distributed over said substrate and integral therewith, the total surface of said cathode including the sidewalls of the bosses being covered with a coating of an adherent layer of an electrolyte resistant, substantially impermeable, low conductivity material, except for the exposed faces of said bosses which are adapted to receive electrodeposited metal thereon, the coated sidewalls of said raised bosses extending upwardly from the coated laminar metal substrate, passing a current from said anode to said cathode whereby metal is electrodeposited on the raised exposed faces of said bosses, and continuing said deposition until the desired size of electrodeposited slugs is obtained on the raised faces of said bosses.

7. The method of claim 6, wherein the electrolyte resistant material is a fluorinated hydrocarbon and wherein following the completion of said deposition of metal, the cathode is removed from the electrolyte and the deposited slugs are mechanically removed from the bosses.

8. The method of claim 7, wherein the raised bosses are cylindrical in shape and wherein substantially each of the electrodeposited slugs has the configuration of a crown.

9. The method of claim 8, wherein the metal electrolyte is a nickel electrolyte and the product obtained from said method is a nickel slug in the shape of a crown.

* * * * *